US006644205B2

(12) United States Patent
Ritman et al.

(10) Patent No.: US 6,644,205 B2
(45) **Date of Patent: *Nov. 11, 2003**

(54) WARHEAD CONFIGURATION

(75) Inventors: Zeev Ritman, Haifa (IL); Gershon Kliminz, Kiryat Motzkin (IL); Mordechai Avitan, Kiryat Motzkin (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

This patent is subject to a terminal disclaimer.

(21) Appl. No.: 09/959,406

(22) PCT Filed: Feb. 16, 2001

(86) PCT No.: PCT/IL01/00147

§ 371 (c)(1),
(2), (4) Date: Oct. 24, 2001

(87) PCT Pub. No.: WO01/63199

PCT Pub. Date: Aug. 30, 2001

(65) Prior Publication Data

US 2002/0157560 A1 Oct. 31, 2002

(30) Foreign Application Priority Data

Feb. 25, 2000 (IL) ..... 134735
Dec. 20, 2000 (IL) ..... 140445

(51) Int. Cl.[7] ..... F42B 12/10

(52) U.S. Cl. ..... 102/476; 102/307; 102/501

(58) Field of Search ..... 102/305–310, 102/473, 475, 476, 491–497, 501, 474; 175/4.6

(56) References Cited

U.S. PATENT DOCUMENTS

| | | | | | |
|---|---|---|---|---|---|
| 2,757,611 | A | | 8/1956 | Church et al. | |
| 2,984,307 | A | | 5/1961 | Barnes | |
| 3,224,372 | A | * | 12/1965 | Nooker | 102/474 |
| 3,244,102 | A | | 4/1966 | Wofford et al. | |
| 3,477,372 | A | | 11/1969 | McFerrin et al. | |
| 3,974,771 | A | * | 8/1976 | Thomanek | 102/476 |
| 4,058,063 | A | * | 11/1977 | Hurst | 102/474 |
| 6,477,959 | B1 | * | 11/2002 | Ritman et al. | 102/476 |

* cited by examiner

*Primary Examiner*—Harold J. Tudor
(74) *Attorney, Agent, or Firm*—Mark M Friedman

(57) ABSTRACT

A warhead (10) configuration for forming a large-diameter hole through a wall of a target includes a shaped charge of explosive material (12) presenting an annular front surface portion (16) circumscribing an axis of the charge. The annular front surface portion (16) exhibits a concave profile as viewed in cross-section through the axis, at least part of the concave profile being configured such that a vector projecting outward from the part normal to the annular front surface portion diverges from the axis. A liner (14) is provided adjacent to at least part of the annular front surface portion.

17 Claims, 3 Drawing Sheets

WARHEAD CONFIGURATION

FIELD AND BACKGROUND OF THE INVENTION

The present invention relates to warhead configurations and, in particular, it concerns a warhead configuration for making a large-diameter hole through a wall of a target.

It is known to employ a shaped charge to produce an intense axial hypervelocity jet for applications such as armor piercing. The shaped charge is generally formed with a conical recess located axially in its front face. This results in intense axial jet that creates a very small hole in the target. In many applications, however, it would be useful to employ a shaped charge to form a relatively large-diameter hole in a wall of a target.

There is therefore a need for a warhead configuration which would form a relatively large diameter hole through a wall of a target.

SUMMARY OF THE INVENTION

The present invention is a warhead configuration for forming a relatively large diameter hole through a wall of a target.

According to the teachings of the present invention there is provided, a warhead configuration for forming a large-diameter hole through a wall of a target, the warhead configuration comprising: (a) a shaped charge of explosive material, the charge having an axis and presenting an annular front surface portion circumscribing the axis, the annular front surface portion being configured so as to exhibit a concave profile as viewed in a cross-section through the shaped charge passing through the axis, at least part of the concave profile being configured such that a vector projecting outward from the part normal to the annular front surface portion diverges from the axis; and (b) a liner adjacent to at least part of the annular front surface portion.

There is also provided according to the teachings of the present invention, a warhead configuration for forming a large-diameter hole through a wall of a target, the warhead configuration comprising: (a) a shaped charge of explosive material, the shaped charge having an axis and presenting a front portion for facing towards the wall during detonation: and (b) a liner adjacent to at least part of the front portion, wherein the shaped charge and the liner arc configured such that, when the shaped charge is detonated, a majority of material from the liner is substantially concentrated into an expanding conical path.

According to a further feature of the present invention, the expanding conical path has an angle relative to the axis of between about 10° and about 50°.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a warhead configuration for forming a large diameter hole through a wall of a target.

The principles and operation of warhead configurations according to the present invention may be better understood with reference to the drawings and the accompanying description.

Figure 1:
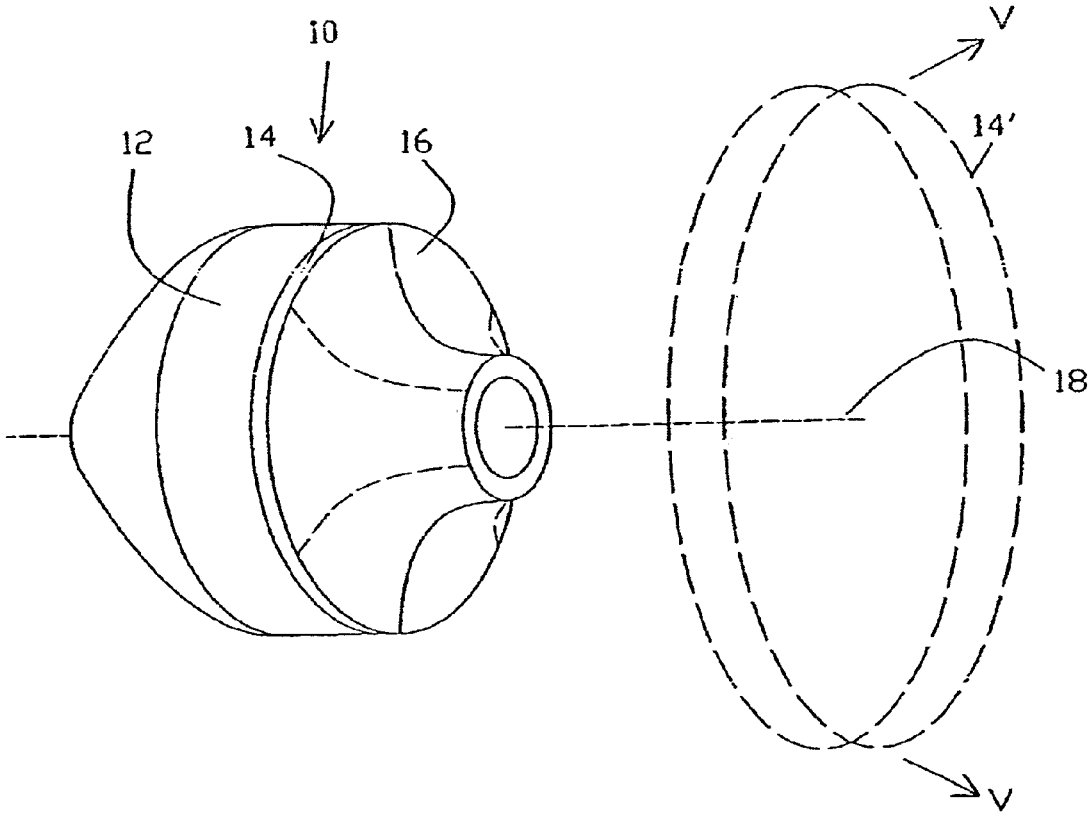
FIG. 1 is an isometric view of a warhead configuration, constructed and operative according to the teachings of the present invention, for forming a large diameter hole through a wall of a target.
Figure 2:
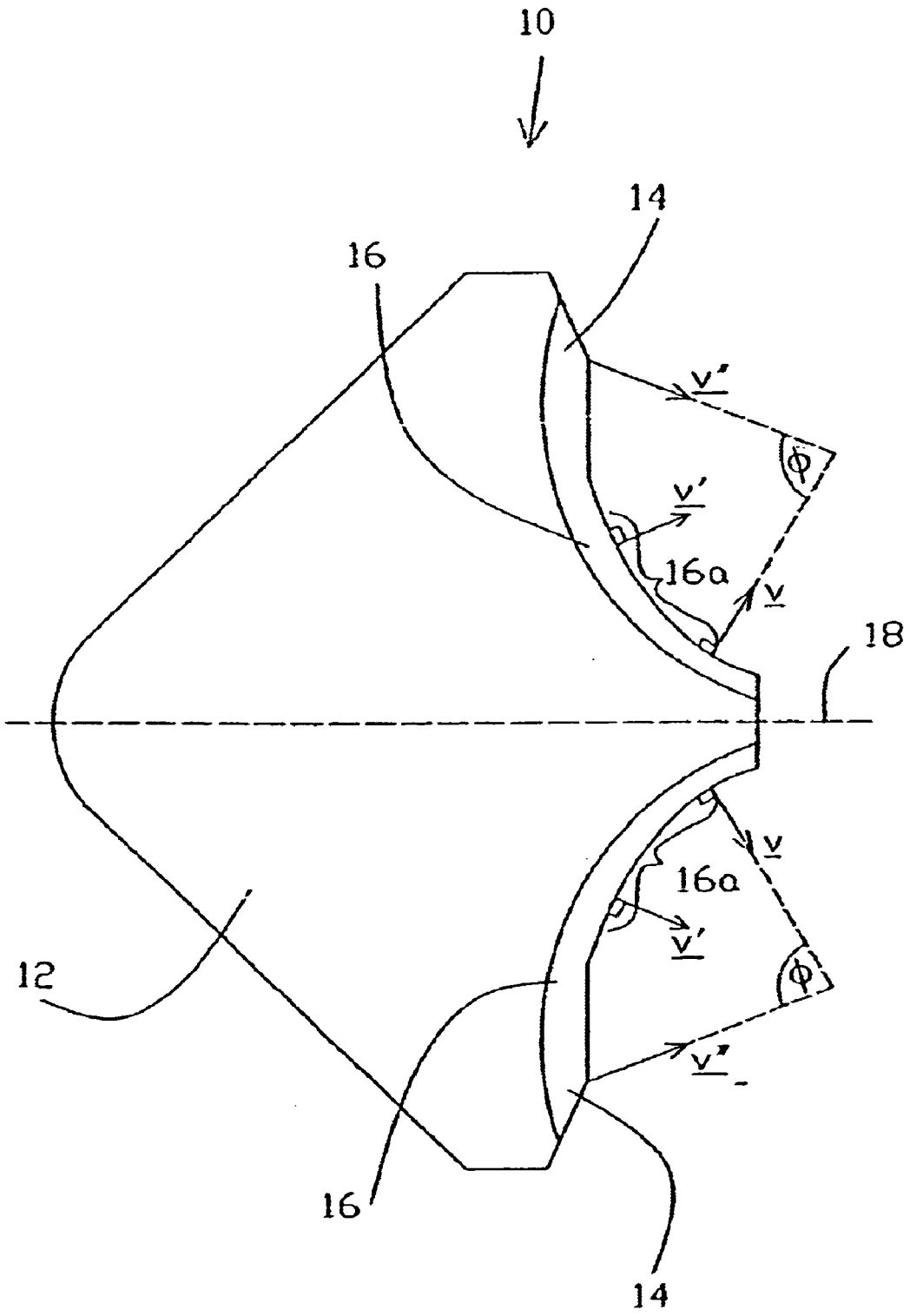
FIG. 2 is a cross-sectional view taken through the axis of the warhead configuration of FIG. 1.

Referring now to the drawings, FIGS. 1 and 2 show a warhead configuration, generally designated 10, constructed and operative according to the teachings of the present invention, for forming a large-diameter hole through a wall of a target. Generally speaking, warhead configuration 10 includes a shaped charge 12 of explosive material having a front portion for facing towards the wall of the target during detonation and a liner 14 adjacent to at least part of the front portion. Shaped charge 12 and liner 14 are configured such that, when shaped charge 12 is detonated, a majority of material from liner 14 is substantially concentrated into an expanding conical path. In preferred cases, the material largely conglomerates into an expanding explosively formed ring ("EFR"), represented schematically by ring 14', which advances at a speed of roughly 2500 m/s, cutting a hole through the wall of the target.

To achieve this effect, shaped charge 12 preferably features an annular front surface portion circumscribing an axis of symmetry 18 of the charge. The annular front surface portion is configured so as to exhibit a concave profile 16 as viewed in FIG. 2 (a cross-section through shaped charge 12 passing through axis 18). At least part of the concave profile, here labeled 16*a*, is configured such that a vector v, v' projecting outward therefrom normal to the annular front surface portion diverges from axis 18. Preferably, other parts of the profile are angled so as to provide normal vectors v" parallel to, or even angled slightly towards, the axis 18. These converging vectors, approximating closely to the direction of the explosive thrust experienced by the different parts of the liner, lead to focusing of the liner into a concentrated ring where they at least partially conglomerate to form the expanding EFR. The ring may break into fragments as it expands. However, the fragments are still generally sufficiently close together to provide a continuous cut through the wall of the target.

It should be noted that the warhead configuration of the present invention is useful in a wide range of applications including, but not limited to, breaching walls and barriers of many kinds.

In a matter of terminology, it will be noted that the warhead configuration of the present invention is described as forming a large diameter hole. It should be noted that the term "large diameter" as used herein in the description and claims refers to a diameter exceeding the outer diameter of the shaped charge. The large diameters achievable by use of the present invention stand in clear distinction to the prior art shaped charges which concentrate the liner into a jet or projectile of diameter smaller than the diameter of the shaped charge.

Turning now to the features of the present invention in more detail, it is a preferred feature of the present invention that the material of liner 14 at least partially conglomerates to form an expanding EFR. To this end, the angular range $\phi$ encompassed by vectors v, v' and v", is preferably sufficiently large to ensure convergence of the material at short range, while being sufficiently small to avoid immediate re-fragmentation from impacts of colliding particles. Preferably, this range of angles, corresponding to the angle turned through by concave profile 16, lies between 15° and 90°, and most preferably, in the range from 30° to 70°. In a preferred case in which the concave profile corresponds to an arc of a circle, this angle corresponds to the angle subtended by the arc at its center of curvature.

The physical properties of the EFR, including the degree of conglomeration, the conical angle of divergence and the speed, are also influenced by a number of other factors. These include: the shape of the charge; the point of detonation; the material and thickness distribution of the liner; and the type and amount of explosive used. The parameters are preferable chosen to impart a velocity to parts of the liner of between about 1000 and about 4000 m/s, and most preferably, of about 2500 m/s. The expanding conical path of the EFR preferably has an angle θ relative to the axis of between about 10° and about 50°. Fine adjustment of the relative velocities of different parts of the liner may be used to shape the cross-sectional profile of the resulting EFR, varying from a round cross-section through a V-shaped cross-section to a flat band.

Figure 3:
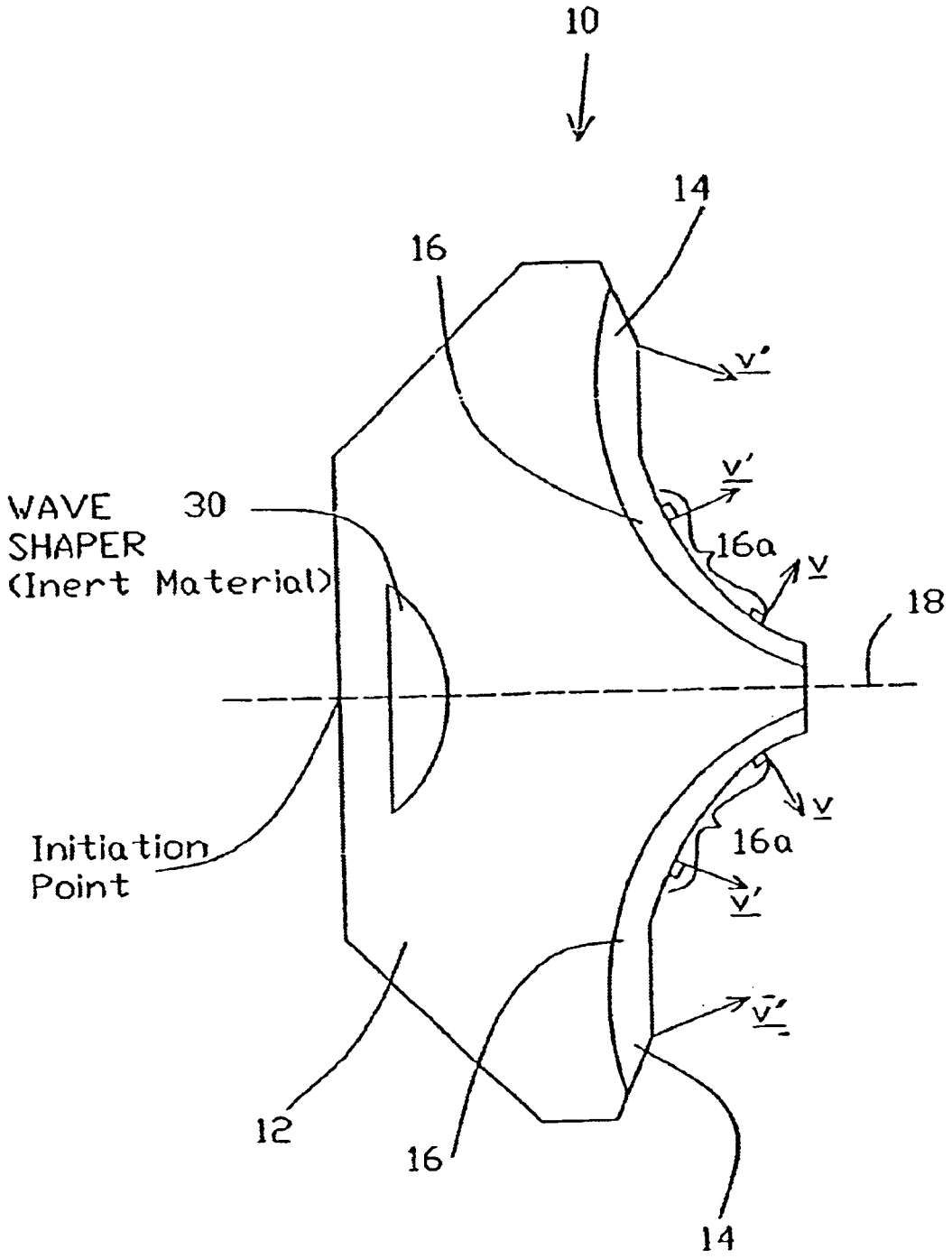
FIG. 3 is a cross-sectional view taken through the axis of a reduced-length variant of the warhead configuration of FIG. 1.

In the implementation shown in FIGS. 1 and 2, initiation is performed at a central position at the rear of the charge. The use of a somewhat elongated conical rear end serves to ensure substantially simultaneous initiation across the annular front surface portion. The initiation method can be changed from point initiation to peripheral initiation. In this way the charge length can be shortened. FIG. 3 illustrates one example of a peripheral initiation implementation where shaped charge 12 includes an inert wave shaper 30 deployed so as to provide a peripheral initiation effect. Alternatively, multi-point initiation may be used.

The material used for liner 14 may be chosen from a wide range of suitable materials. Preferred examples include, but are not limited to, metallic materials such as aluminum, copper, tungsten, steel, iron and tantalum. In certain cases, a liner made from plastic materials may be used.

It should be noted that the surface referred to as the "annular front surface portion" is typically part of a continuous front surface of the charge. The form of the central portion closest to axis 18 is generally not critical to operation of the present invention, but may be adapted according to the given application to provide additional advantageous properties. In most cases, the annular front surface portion corresponds to at least about half of the total front surface of shaped charge 12 as viewed parallel to axis 18, and most preferably, at least about 80% thereof.

In experimental results, warhead configuration 10 has been demonstrated to offer extremely effective cutting properties. When detonated a short distance from a wall, a clean circular hole is produced. The diameter of a hole produced is about 1–10 times the charge diameter when detonated from a standoff of about 1–5 charge diameters depending upon the target material and thickness. When the axis of the charge is not aligned perpendicular to the wall, an elliptical shaped hole is created. The cutting ability for cutting through steel is between about 0.1 and about 0.2 of the charge diameter, depending upon the specific liner material used.

It will be appreciated that the above descriptions are intended only to serve as examples, and that many other embodiments are possible within the spirit and the scope of the present invention.

What is claimed is:

1. A warhead configuration for forming a large-diameter hole through a wall of a target, the warhead configuration comprising:

(a) a charge of explosive material, said charge having an axis and presenting an annular front surface portion circumscribing said axis, said annular front surface portion being configured so as to exhibit a concave profile as viewed in a cross-section through said charge passing through said axis, at least part of said concave profile being configured such that a vector projecting outward from said part normal to said annular front surface portion diverges from said axis, said concave profile turning through no more than 90°, wherein said concave profile corresponds substantially to an arc of a circle, said arc subtending an angle of between 15° and 90° to a center of curvature of said arc; and (b) a liner adjacent to at least part of said annular front surface portion, wherein said charge and said liner are configured such that, when said charge is detonated, material from said liner is formed into an expanding explosively formed ring.

2. The warhead configuration of claim 1, wherein said annular front surface portion is substantially rotationally symmetric about said axis.

3. The warhead configuration of claim 1, wherein said arc subtends an angle of between 30° and 70° to a center of curvature of said arc.

4. The warhead configuration of claim 1, wherein said annular front surface portion corresponds to at least about half of the total front surface of said charge as viewed parallel to said axis.

5. The warhead configuration of claim 1, wherein said annular front surface portion corresponds to at least about 80% of the total front surface of said charge as viewed parallel to said axis.

6. The warhead configuration of claim 1, wherein said charge and said liner are configured such that detonation of said explosive material imparts a velocity to said material from said liner of between about 1000 and about 4000 m/s.

7. The warhead configuration of claim 1, wherein said explosively formed ring follows an expanding conical path having an angle relative to said axis of between about 10° and about 50°.

8. The warhead configuration of claim 1, wherein said liner extends continuously over substantially the entirety of said annular front surface portion.

9. A warhead configuration for forming a large-diameter hole through a wall of a target, the warhead configuration comprising:

(a) a charge of explosive material, said charge having an axis and presenting an annular front surface portion circumscribing said axis, said annular front surface portion being configured so as to exhibit a concave profile as viewed in a cross-section through said charge passing through said axis, at least part of said concave profile being configured such that a vector projecting outward from said part normal to said annular front surface portion diverges from said axis, said concave profile turning through no more than 90°, wherein said annular front surface portion corresponds to at least about 80% of the total front surface of said charge as viewed parallel to said axis; and (b) a liner adjacent to at least part of said annular front surface portion, wherein said charge and said liner are configured such that, when said charge is detonated, material from said liner is formed into an expanding explosively formed ring.

10. The warhead configuration of claim 9, wherein said annular front surface portion is substantially rotationally symmetric about said axis.

11. The warhead configuration of claim 9, wherein said concave profile corresponds substantially to an arc of a circle.

12. The warhead configuration of claim 11, wherein said arc subtends an angle of between 30° and 70° to a center of curvature of said arc.

13. The warhead configuration of claim 9, wherein said concave profile turns through an angle of between 15° and 90°.

14. The warhead configuration of claim 9, wherein said concave profile turns through an angle of between 30° and 70°.

15. The warhead configuration of claim 9, wherein said charge and said liner are configured such that detonation of said explosive material imparts a velocity to said material from said liner of between about 1000 and about 4000 m/s.

16. The warhead configuration of claim 9, wherein said explosively formed ring follows an expanding conical path having an angle relative to said axis of between about 10° and about 50°.

17. The warhead configuration of claim 9, wherein said liner extends continuously over substantially the entirety of said annular front surface portion.

* * * * *